United States Patent [19]

Gantke et al.

[11] 4,050,212

[45] Sept. 27, 1977

[54] PROFILE STEEL

[75] Inventors: Franz Gantke; Harald Walter; Walter Zywietz, all of Dortmund, Germany

[73] Assignee: Hoesch Werke Aktiengesellschaft, Dortmund, Germany

[21] Appl. No.: 739,641

[22] Filed: Nov. 8, 1976

[30] Foreign Application Priority Data

Nov. 11, 1975 Germany ..... 2550577

[51] Int. Cl.[2] ..... E04C 3/30

[52] U.S. Cl. ..... 52/726; 52/731

[58] Field of Search ..... 52/730, 731, 720, 726; 403/345, 363, 376

[56] References Cited

U.S. PATENT DOCUMENTS

| | | | |
|---|---|---|---|
| 2,573,345 | 10/1951 | Leedy | 52/731 X |
| 2,577,671 | 12/1951 | Barrett | 52/731 |
| 3,055,399 | 9/1962 | Bush et al. | 52/731 X |
| 3,606,418 | 9/1971 | Baker et al. | 52/726 X |
| 3,815,311 | 6/1974 | Nisula | 52/731 X |
| 3,974,619 | 8/1976 | Turner | 52/726 |

FOREIGN PATENT DOCUMENTS

| | | | |
|---|---|---|---|
| 429,090 | 7/1967 | Switzerland | 52/731 |

*Primary Examiner*—J. Karl Bell

*Attorney, Agent, or Firm*—Walter Becker

[57] ABSTRACT

A profile steel of an about U-shaped cross section, which has a profile bottom with webs and flanges slightly inclined toward each other and extending in the direction toward the open profile side. This profile steel, which is particularly well suited as profile steel segment when preparing reinforcing frames in connection with the building of mine shafts and tunnels, has a profile bottom which at its longitudinal sides has steps directed to the open side of the profile. These steps merge with the above mentioned webs which in their turn at the ends remote from the steps end in flanges pointing toward each other.

2 Claims, 4 Drawing Figures

FIG. 3
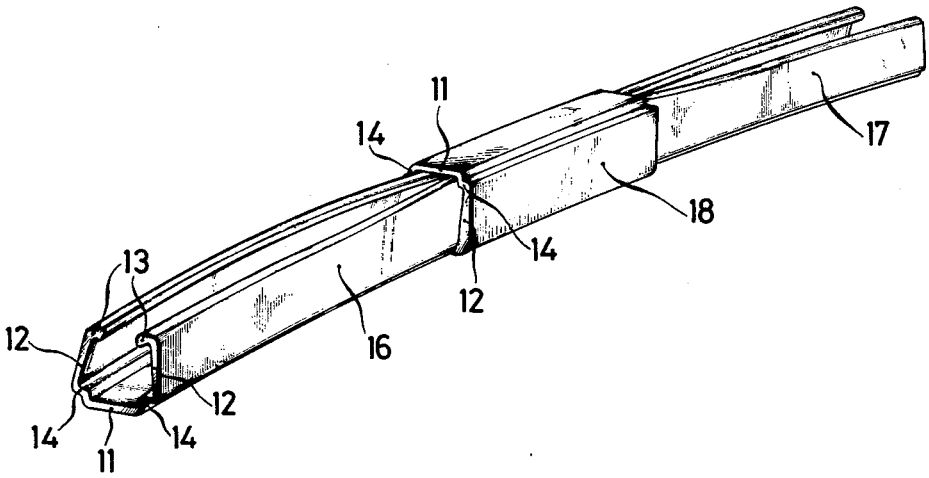
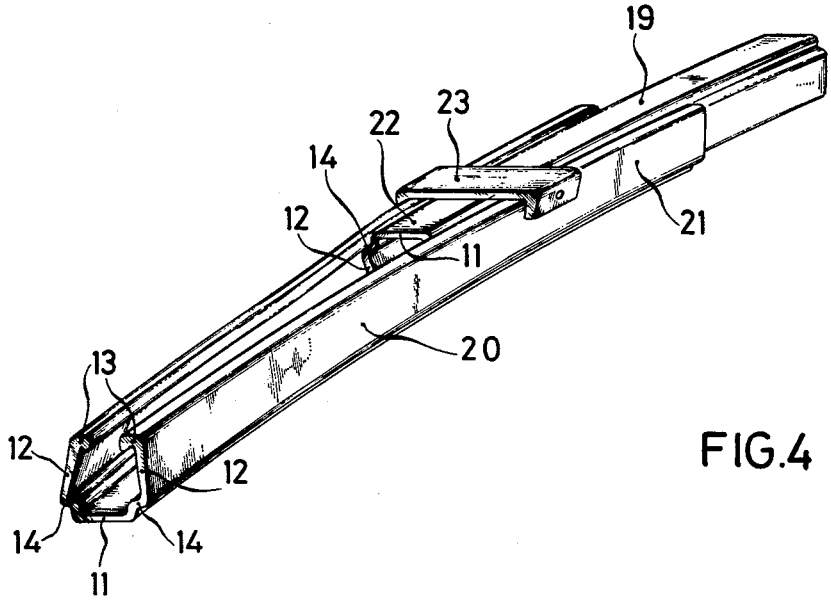
FIG.4

PROFILE STEEL

The present invention relates to a profile steel having a substantially U-shaped cross section with a profile bottom and with webs and flanges slightly inclined toward each other and extending in the direction toward the open profile side, especially for insertion as profile steel segment when building a supporting frame for mine shafts, etc.

Profile steels of the above mentioned general type are disclosed for instance in German Pat. No. 682,147. In view of the slightly inwardly inclined webs, a better form stability is realized in view of the high resistance value in the vertical as well as in the horizontal plane over trough-shaped profile steels; however, the outwardly pointing arrangement of the flanges arranged as web reinforcement on the open profile side cannot be considered a very favorable solution to the problem involved. These outwardly located flanges unfavorably influence the static values, the resistance moment and inertia moment about the Y-axis and also affect the form stability under the high occurring bending drill buckling loads. Furthermore, these profile steels have a shape which is not favorable with regard to the rolling technique.

As profile steel segments, profile steels are employed for the yieldable as well as the rigid reinforcement of mine shafts. At the respective connecting areas, the profile segments are with a yieldable construction inserted into each other in the same direction so that they overlap each other to a certain extent. This arrangement has the drawback that the profile steel segments have to be held together by means of frequently rather expensive elements such as clamping vices in connection with screws the heads of which have to be wedge-shaped in conformity with the inclination of the webs. With progressive insertion, the said elements lose their connection outside said clamping vices.

It is, therefore, an object of the present invention to provide a profile steel for the insertion as profile steel segment when building reinforcement frames for the yieldable as well as rigid reinforcement of mine shafts, which will overcome the above mentioned drawbacks.

It is still another object of this invention to provide a profile steel as set forth in the preceding paragraph which will have a statically favorable shape and will also be in conformity with modern rolling techniques and by means of which the frames can be held together without expensive clamping elements and links.

These and other objects and advantages of the invention will appear more clearly from the following specification in connection with the accompanying drawings, in which:

FIG. 3 illustrates an isometric view of a section of a rigid reinforcing frame.

FIG. 4 is an isometric view of a yieldable reinforcing frame.

The profile steel according to the present invention is characterized primarily in that the profile bottom at its longitudinal sides merges with outwardly extending stepped sections having connected thereto webs which are directed to the open side of the steel profile. The profile steel according to the invention is further characterized in that the web reinforced flanges at the free ends of said web point toward each other.

Advantageously the reinforced flanges are at their free ends designed in the form of jaws. The distance of the inner edges of the jaws from the profile bottom should preferably be about twice the distance of the outer edges of the jaws from the stepped sections Profile steels of the type represented by the present invention can easily be rolled and have a mass distribution of the workpiece over the profile which is highly favorable in static respect. With a reinforcing frame made out of profile steel segments according to the invention, the profile segments which overlap each other at the connecting and reinforcing sections are placed in each other in an inversed manner with regard to each other. When inserting said profile steel segments into each other, the inner surfaces of the flanges of the outer profile segment correspond to the outer surfaces of the steps of the inner profile segment, whereas the flanges of the inner profile steel segment rest against the inner surface of the profile bottom of the outer profile steel segment, and within the region of the webs, there will occur a bracing relative to each other and relative to the inner surfaces of the steps of the profile bottom.

The advantages of the reinforcing frame are seen particularly in the fact that the individual profile steel segments are pushed together without expensive clamping elements and links, and that due to the obtained box shape a high form stability will be assured when high bending drill buckling loads occur.

Figure 1:
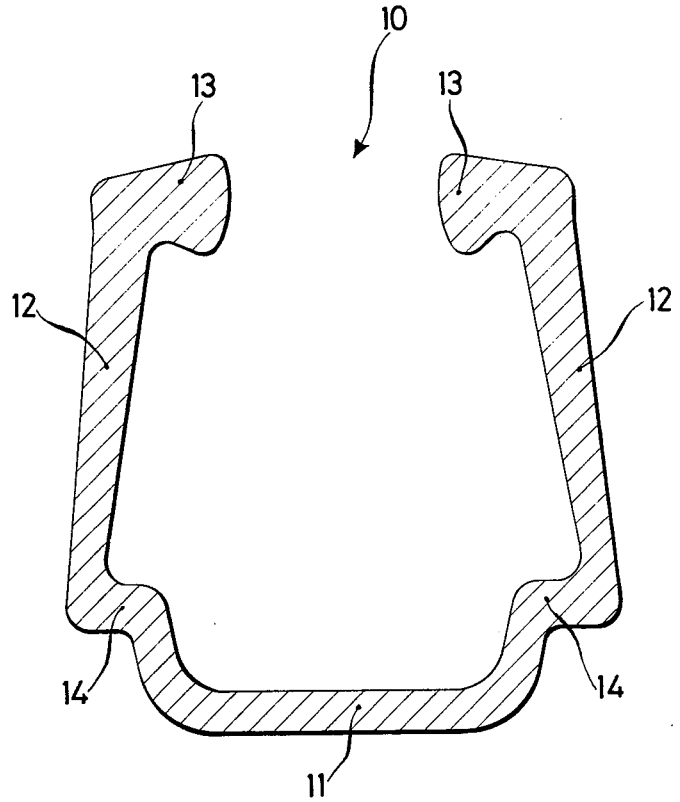
FIG. 1 represents a cross section through a profile steel according to the invention.
Figure 2:
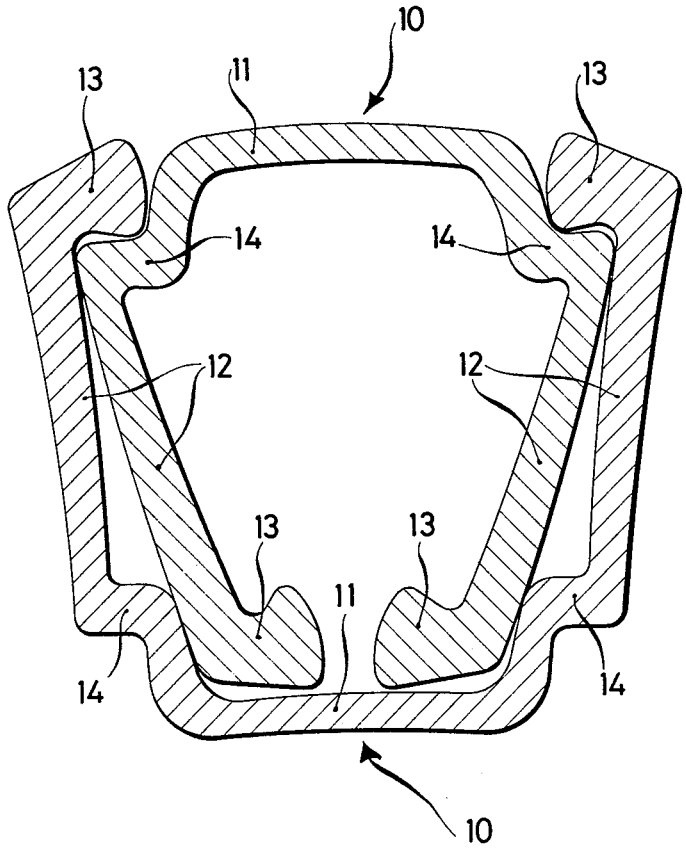
FIG. 2 shows a cross section through two profile steel segments one pushed into the other.

Referring now to the drawings in detail, it will be seen from FIGS. 1–4 that a profile steel 10 has a profile bottom 11 of an approximately U-shaped cross section which toward the open profile side is provided with webs 12 and flanges 13 which are slightly inclined relative to each other. The profile bottom 11 has its longitudinal sides merging with steps 14 directed toward the open profile side. These steps 14 are continued in the form of webs 12 which end in inwardly directed flanges 13. The web reinforcing flanges 13 arranged at the wider end of the webs 12 are jaw-shaped.

As will be evident from FIG. 3, with a rigid reinforcing frame, the individual profile steel segments 16, 17 have their end faces butt joint and the end of the corresponding profile steel segments 16, 17 are pressed together so that the web reinforced flanges 13 are almost abutting each other, whereupon upon their pressed together profile steel segment ends there is placed in an inversed position with regard to the segments 16 and 17, a widened profile member 18 common to both said segments 16 and 17 which segment 18 forms a cover plate means or a link. The inner surfaces of the flanges 13 of the profile member 18 placed upon the outside of segments 16 and 17 correspond to the outer surfaces of the steps 14 of the inwardly located profile steel segments 17 and 16 whereas the flanges 13 of the inwardly located profile steel segments 16 and 17 rest against the inner surface of the profile bottom 11 of the outwardly placed profile steel member 18, and within the region of the webs 12 a bracing relative to each other and relative to the inner surfaces of the steps 14 of profile bottom 18 is effected (see also FIG. 2). The supporting force of the connection may be increased by a simple clamp (not shown) to be placed upon the profile steel member 18.

FIG. 4 shows how with a yieldable reinforcing frame the adjacent profile steel segments 19, 20 are moved into each other. With an inversed placing into each other of the profile segments 19, 20 whereby a box form is created, the end 21 of the profile steel segment 20 is widened to such an extent that the end 22 of the profile steel segment 19 which is pressed together so that the web reinforcing flanges 13 almost abut each other can be inserted into the end 21 of the profile steel segment 20. The ends 21, 22 of the profile segments 19, 20 inserted into each other will then brace each other in the same manner as with the above described rigid reinforcing frame.

The embracing of the end 22 of the profile steel segment 19 by the end 21 of the profile steel segment furnishes particular safety for the connection of the segments. The forces which in this way will be conveyed depend merely on the profile steel dimensions (profile weights) and are not at all or only to a negligible extent depending upon the frictional coefficients, clamping forces, or the like. When inserting the narrowed end 22 of the profile steel segment 19 into the widened end 21 of the profile steel segment 20, a resistance against the form change has to be overcome in the rolled profile. The process of the progressive placing into each other of the segments 19, 20 takes place automatically in conformity with the rock pressure. The width of the widened end 21 of the profile steel segment 20 may, if necessary, be kept constant by a simple clamp 23 which has to be dimensioned merely for absorbing deformation forces of the second order but not for the clamping forces. In this connection, the cross sections of both ends 21, 22 of the profile steel segments 19, 20 remain uniformly in engagement with each other so that a breaking out under the rock pressure will not be possible. Under special rock conditions, the insertion resistance can be increased by providing clamps of variable opening widths on different places of the profile steel segment 20.

It is, of course, to be understood that the present invention is, by no means, limited to the specific showing in the drawings but also comprises any modifications within the scope of the appended claims.

What we claim is:

1. A structural frame member, especially for use in connection with the building of mine shafts and tunnels, which includes: two channel-shaped profile steel elements each of which comprises a bottom with lateral steps and lateral webs respectively forming extensions of said steps and being inclined toward each other while extending in a direction away from said bottom, the free ends of said webs forming flanges facing each other, each of said two profile steel elements having the lateral web portions at one end thereof bent together while the bent together web portions of one profile steel element are in alignment with and substantially abut the bent together web portions of the other profile steel element; and a third channel-shaped profile steel element corresponding in shape substantially to the shape of said first mentioned two channel-shaped profile steel elements but without bent together web portions, said third channel-shaped profile steel element in an upside down position with regard to said other two channel-shaped profile steel elements being common to and straddling said abutting and bent together web portions and holding them together, the inner surfaces of the flanges of said third channel-shaped profile steel element corresponding to the outer surfaces of said steps of said first mentioned two channel-shaped profile steel elements, and said flanges of said first mentioned two channel-shaped profile steel elements resting against the inner surface of the bottom of said third channel-shaped profile steel element, while the webs of said third channel-shaped profile steel element rest against the webs of said first mentioned two channel-shaped profile steel elements in the region of the steps thereof, and while the flanges of said third channel-shaped profile steel element rest against the outer surfaces of the steps of said first mentioned two channel-shaped profile steel elements.

2. A frame member according to claim 1, in which said flanges are jaw-shaped, and in which said lateral webs increase in cross section from said steps toward said flanges.

* * * * *